United States Patent [19]

Smith et al.

[11] 4,090,704

[45] May 23, 1978

[54] REGISTRATION STATION

[75] Inventors: Richard E. Smith, Webster; Thomas J. Hamlin, Macedon; Klaus K. Stange, Pittsford; James R. Cassano, Penfield, all of N.Y.

[73] Assignee: Xerox Corporation, Stamford, Conn.

[21] Appl. No.: 786,321

[22] Filed: Apr. 11, 1977

Related U.S. Application Data

[62] Division of Ser. No. 627,570, Oct. 31, 1975.

[51] Int. Cl.[2] ..... B65H 9/06

[52] U.S. Cl. ..... 271/246; 271/195; 271/236

[58] Field of Search ..... 271/194, 195, 211, 226, 271/234, 236, 246, 250, 251, 264

[56] References Cited

U.S. PATENT DOCUMENTS

| | | | |
|---|---|---|---|
| 1,107,859 | 8/1914 | Stevens | 271/211 |
| 3,517,923 | 6/1970 | Hoffman et al. | 271/246 |
| 3,624,807 | 11/1971 | Schwebel | 271/236 |
| 3,784,189 | 1/1974 | Thiel | 271/264 |
| 3,918,706 | 11/1975 | Craft | 271/250 |

*Primary Examiner*—Robert W. Saifer
*Attorney, Agent, or Firm*—Carlos Nieves; James J. Ralabate

[57] ABSTRACT

Apparatus for registering a sheet with respect to perpendicularly related axes is disclosed. Structurally, each embodiment disclosed includes (a) a sleeve for internally accomodating a sheet, at least one point on an inner narrow wall of the sleeve being aligned in parallel with one of the axes; (b) a retractable gate located at one end of the sleeve, in one position the gate having at least one point aligned in parallel with the other of the axes; and (c) means for providing in the sleeve a fluid stream having velocity components normal to each of the axes, whereby when the gate is in said position and a sheet is placed in the sleeve, the stream moves the sheet into abutment with each of said points.

3 Claims, 7 Drawing Figures

REGISTRATION STATION

This is a division of application Ser. No. 627,570, filed Oct. 31, 1975.

The subject invention generally relates to pneumatic transports and, in particular, to transports used to register articles carried thereby.

The use of fluid to move articles into registration with stops is known. In fact, such use of fluids is disclosed in U.S. Pat. No. 3,588,096, issued to Leigh D. Leiter on June 28, 1971. More particularly, the patent discloses apparatus wherein fabric is delivered to a horizontally disposed support including recessed areas housing upwardly pointed nozzles. The nozzles are aligned in two different directions, and the nozzles pointing in one direction are alternately actuated with respect to the nozzles pointing in the other direction to move the fabric into registration in perpendicular directions. Further, the use of fluids for rectilinearly moving an article within a conduit or chamber is also known. In fact, this concept is disclosed in U.S. Pat. No. 3,422,411, issued to J. E. Smith, Jr., on Jan. 14, 1969. More specifically, this patent discloses a data storage cartridge which has an enclosed transfer chamber housing a data storage card. Air pressure and vacuum pressure are switched between opposite ends of the chamber to reciprocally move the card retilinearly in the chamber.

It is noted that with the apparatus disclosed by Leigh D. Leiter as fabric is advanced, or when fabric which is smaller than the distance between nozzles is to be registered, some of the nozzles discharge into the surrounding air without having any effect on the fabric as it is moved into registration. In addition, it is noted that in the system disclosed by J. E. Smith, Jr., lateral registration is provided by the distance between walls of the chamber which are parallel to the direction of travel of the storage card. Thus, the system cannot be used with cards having different width dimensions.

It is an object of the present invention to provide apparatus for registering a sheet with respect to perpendicularly related axes, the sheet having any one of a range of sizes.

It is another object of the present invention to provide apparatus for efficiently moving a sheet into registration with perpendicularly related axes.

Still another object of the present invention is to provide fluidic registration apparatus wherein registered sheets may be engaged for movement to another station.

Briefly, the invention disclosed herein may be used for registering a sheet with respect to perpendicularly related axes, so long as the sheet has length and width dimensions within predetermined ranges. Structurally, the invention may be implemented with (a) a sleeve for internally accommodating said sheet, at least one point on an inner narrow wall of the sleeve being aligned in parallel with one of the axes; (b) a retractable gate located at one end of the sleeve, in one position the gate having at least one point aligned in parallel with the other of the axes; and (c) means for providing in the sleeve a fluid stream having velocity components normal to each of the axes, whereby when the gate is in said position and a sheet is placed in the sleeve, the stream moves the sheet into abutment with each of said points.

Apparatus built according to the invention may be used to register flimsy sheets, such as thin paper. Advantageously, loose particles undersirably located on either side of the sheets are removed from the sheets during transportation.

Additional objects and features of the invention will become apparent by reference to the following description in conjunction with the accompanying drawings, in which.

Figure 1:
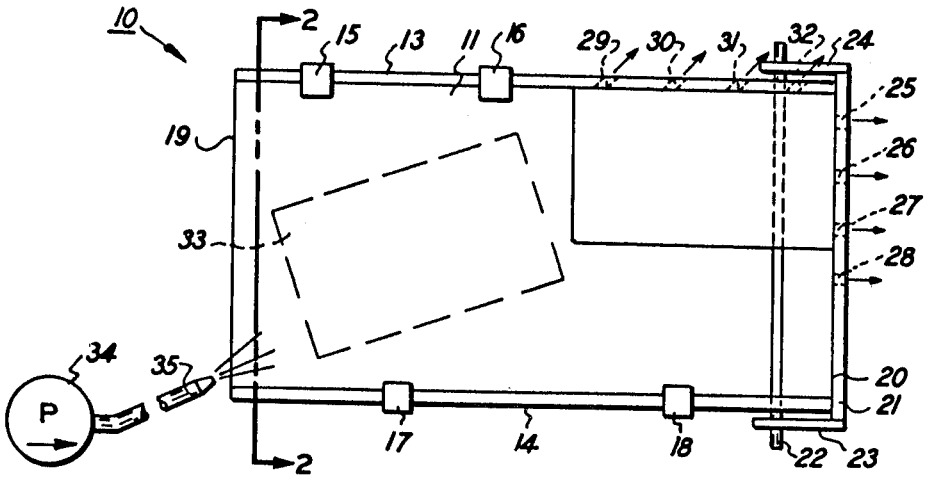
FIG. 1 is a top plan view of registration apparatus, according to the invention, a sheet being shown therein in an unregistered position (dotted lines) and in a registered position.
Figure 2:
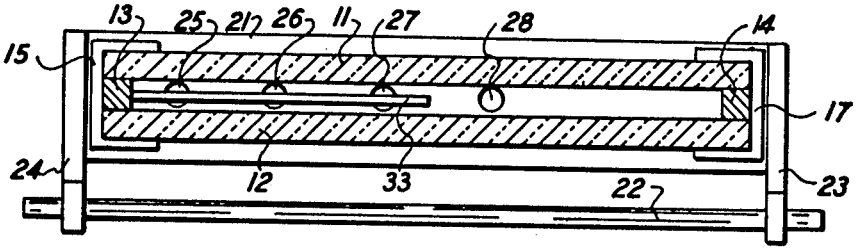
FIG. 2 is a cross-sectional view of the registration apparatus, taken along line 2—2 in FIG. 1.
Figure 3:
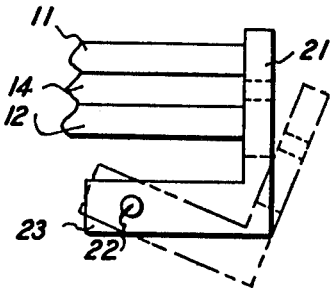
FIG. 3 is a partial front plan view of the registration apparatus shown in FIG. 1, the view showing a gate in a closed position and in an open position (dotted lines)

Registration apparatus 10, according to the invention, is shown in FIGS. 1 and 2. Typically, the apparatus includes a pair of structurally indentical rectangular plates 11 and 12, a pair of elongated rectangular members 13 and 14 disposed between the plates along longitudinally extending edges, and clamps 15–18 for holding the plates and elongated members together to form a rectangular sleeve. The plates are vertically aligned, and the elongated members are coterminous with the plates at both ends 19 and 20. Adjacent end 20 there is located a retractable gate having an abutment 21, a rotatable rod 22, and brackets 23 and 24 coupling the rod 22 to the abutment 21. Rod 22 is used to bring the abutment into contact with end 20, thereby closing off end 20 of the sleeve, or to move the abutment away from end 20. The abutment 21 includes a plurality of ports 25–28 communicating with the space in the sleeve when the abutment is moved against end 20. Elongated member 13 also includes a plurality of ports 29–32 communicating with the space in the sleeve, the ports in the gate and sleeve being located adjacent a common corner when the abutment is against end 20. The plates and the elongated members are assembled in a fluid tight manner, such that fluid entering through the open end of the sleeve moves towards the common corner and exits through the ports. When the gate is closed, the abutment is perpendicularly disposed with regard to the elongated members and, therefore, the common corner may be aligned with X and Y axes. The top and bottom plates are spaced from each other by approximately one-sixteenth of an inch, and a sheet of paper which is smaller than the length and width of the space in the sleeve may be inserted therein as is indicated by the dotted lines. If, thereafter, a pump 34 and nozzle 35 direct fluid into the open end of the sleeve, the fluid flow through the sleeve will float the sheet into registration at the common corner. Referring to FIG. 3, to move the sheet out of registration, the gate may be opened and fluid may be used to move sheet 33 out of the sleeve through end 20. Alternatively, a fluid stream may be injected into the sleeve to move sheet 33 out of the sleeve through end 19. In this embodiment, the top and bottom plates are manufactured from glass. Thus, sheets brought into registration may be read, may be photographed, or may be scanned with suitable equipment.

The registration apparatus disclosed above may be modified or supplemented in a number of ways, some of which are set forth below. In describing the various embodiments, similar reference numerals will be used to designate components previously described.

Figure 4:
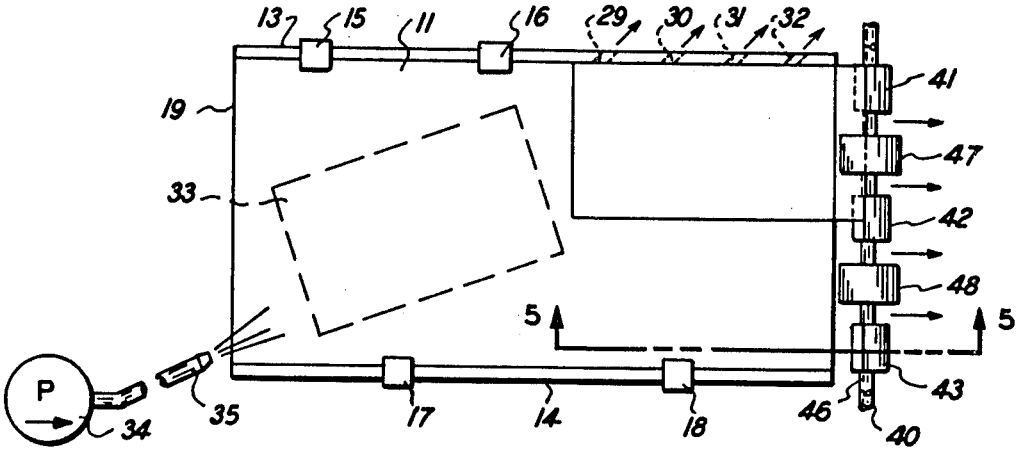
FIG. 4 is a top plan view of another embodiment of registration apparatus, according to the invention, a sheet being shown therein in an unregistered position (dotted line) and in a registered position.
Figure 5:
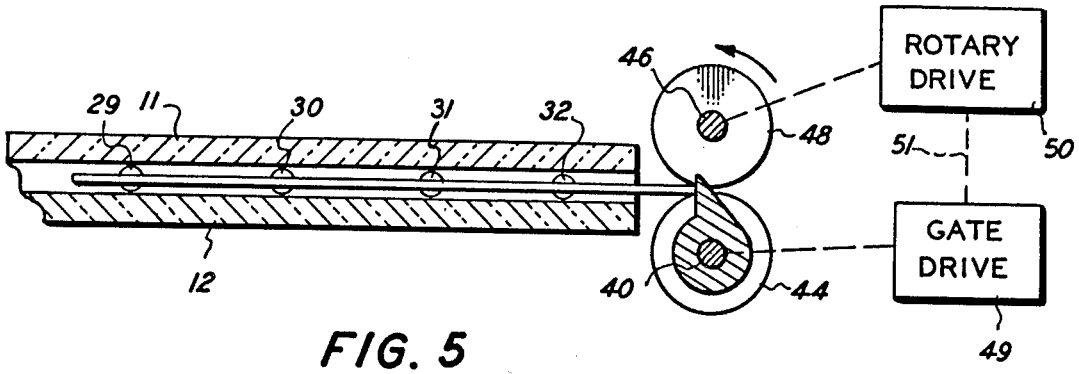
FIG. 5 is a partial cross-sectional view of registration apparatus, taken along line 5—5 in FIG. 4, and means for driving the apparatus.

Referring to FIGS. 1, 4, and 5, it may be seen that registration apparatus shown in FIGS. 4 and 5 differs from that shown in FIG. 1 in that a different type of gate is used. More particularly, the gate includes a lower arrangement comprising a rotatable rod 40, three spaced abutments 41–43 secured to rod 40 and two rollers 44 (only one is shown), each of the rollers being located between a different pair of stops. An upper arrangement of the gate includes a rotatable rod 46, disposed in parallel with rod 40, and a pair of drive rollers 47 and 48 cooperating with the rollers on rod 40 to provide nips for advancing sheets, such as 33, in the sleeve. In one position, abutments 41–43 are aligned in a direction which is perpendicular with elongated member 13, and, as previously described, a sheet 33 may be brought into registration. However, rotation of rod 40 by a gate drive 49 may be used to drive the abutments out of the way of a registered sheet 33 and thereafter a rotary drive 50 may be used to advance the sheet at a predetermined speed. An interlocking arrangement 51 may be used to make sure that the abutments are out of the way before the nips advance sheets in registration. If desired, pump 34 may be shut off when the sheet 33 is being advanced out of the sleeve.

Figure 6:
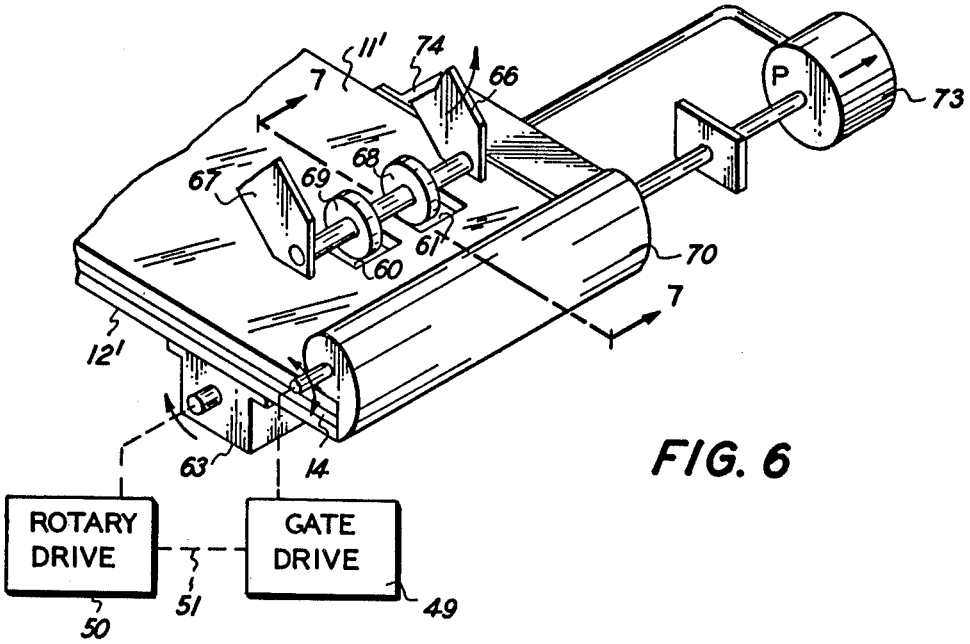
FIG. 6 is a partial perspective view of still another embodiment of registration apparatus, according to the invention.
Figure 7:
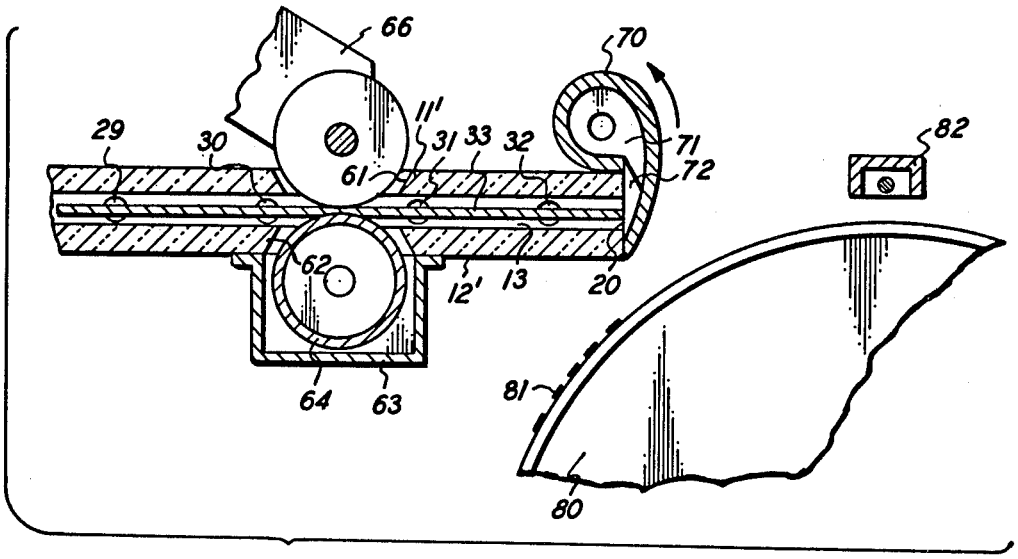
FIG. 7 is a partial cross-sectional view of registration apparatus, taken along line 7—7 in FIG. 6, the apparatus being located adjacent a xerographic transfer station.

FIGS. 6 and 7 show registration apparatus having a sleeve which is similar to the one shown in FIG. 1, except that the top plate 11′ includes a pair of holes 60 and 61 and bottom plate 12′ includes a hole 62 disposed beneath the pair of holes 60 and 61. A shroud 63 fixed to plate 12′ rotatably supports a drive roller 64 extending into the space in the sleeve and a pair of pivotable brackets support a pair of idler rollers 68 and 69, the idler rollers 68 and 69 being movable through holes 61 and 60, respectively, to form a nip with drive roller 64. When rollers 68 and 69 are out of engagement with roller 64, sheet 33 may be brought into registration with the elongated member 13 and abutments on a retractable gate. In this embodiment, the gate is a rotatable manifold having a chamber 71 which may be positioned in communication with the space in the sleeve at end 20, and a plurality of ribs 72 (only one shown) in the chamber which serve as abutments. Chamber 71 is coupled to a vacuum pump 73. Pump 73 is also coupled to a manifold 74 fixed to the sleeve such that its chamber communicates with ports 29–32. As a result, if the pump is turned on and the rollers 68 and 69 are in retracted position, a sheet 33 may be drawn into registration. After registration, rollers 68 and 69 can be moved to engage sheet 33, and the gate drive 49 can rotate the manifold to move the abutments out of the way of sheet 33. If desired, prior to such movement pump 73 may be turned off. Rotary drive 50 is coupled to the drive roller 64 and may be used to advance sheet 33 out of the sleeve at a predetermined rate. An interlocking arrangement 51 may be used to make sure that the abutments are out of the way before a sheet is advanced.

It may be noted that when a sheet is being drawn into registration, fluid will flow into the sleeve through its end and through holes 60 and 61. However, the flow of air through the holes 60 and 61 does not adversely affect registration. If desired, fluid may be injected through end 19 to accelerate registration, but care should be taken not to create a situation wherein there exists a new flow of air out of the sleeve through holes 60 and 61. Alternatively, a shroud (not shown) covering the holes 60 and 61 and the rollers 68 and 69 may be provided, it being understood that other means will have to be used to move the rollers if the shroud is to be fluid tight.

Referring to FIG. 7, the registration apparatus shown may be used to supply sheets of paper to a xerographic transfer station having, for example, a drum 80 bearing a toner image 81 and a corotron 82 for transferring the toner image to the paper. In this arrangement, the rate at which sheets are advanced is synchronized with the rotation of the drum to avoid image distortion, and fluid is not injected into the sleeve when the gate is open to avoid disturbance of the toner image on the drum.

It is to be understood that the description herein of preferred embodiments, according to the invention, have been set forth as examples thereof and are not to be construed or interpreted as limitations on the claims which follow and define the invention.

What is claimed is:

1. Apparatus for registering a sheet with respect to perpendicularly related axes, the sheet having a length and width within predetermined ranges, comprising:

(a) a sleeve for internally accommodating said sheet, at least one point on an inner narrow wall of the sleeve being coincident with one of the axes;

(b) a retractable gate located at one end of the sleeve, the gate including a rotatable rod, a manifold coupled to the rod and having at least one rib and a chamber, and means for rotating the rod to bring said at least one rib into or out of the way of travel of a sheet in the sleeve, in one position at least one point on said at least one rib being coincident with the other of the axes;

(c) means for providing in the sleeve a fluid stream having velocity components normal to each of the axes, including a vacuum pump coupled to the chamber; and (d) means for moving a registered sheet out of the sleeve at a predetermined rate, including a drive roll, a driven roll, and drive means for the drive roll, said driven roll being mounted on a rod and said drive roll being responsive to movement of said at least one rib out of said way of travel.

2. Apparatus as defined in claim 1 wherein said means for providing a fluid stream includes at least one port in said narrow wall and a fluid source for injecting fluid into the sleeve.

3. Apparatus as defined in claim 1 wherein the sleeve includes a top wall having a hole and a bottom wall having a hole; and wherein the drive roll extends through the bottom wall, and the driven roll is moveable through the hole in the top wall to provide a nip for driving a registered sheet in the sleeve, the movement of the driven roll being responsive to movement of the said at least one rib out of said way of travel.

* * * * *